US009822511B2

(12) United States Patent
Tuto Faja et al.

(10) Patent No.: US 9,822,511 B2
(45) Date of Patent: Nov. 21, 2017

(54) MALE AND FEMALE PARTS FOR A WEAR ASSEMBLY OF AN EARTH-MOVING MACHINE'S BUCKET

(71) Applicant: METALOGENIA RESEARCH & TECHNOLOGIES S.L., Premia de Mar (ES)

(72) Inventors: Joan Tuto Faja, Fornells de la Selva (ES); Justo Jesus Ortiz Gracia, Barcelona (ES); Jorge Triginer Boixeda, Barcelona (ES)

(73) Assignee: METALOGENIA RESEARCH & TECHNOLOGIES S.L., Premia de Mar (ES)

( * ) Notice: Subject to any disclaimer, the term of this patent is extended or adjusted under 35 U.S.C. 154(b) by 28 days.

(21) Appl. No.: 14/907,252

(22) PCT Filed: Jul. 17, 2014

(86) PCT No.: PCT/EP2014/065387
§ 371 (c)(1),
(2) Date: Jan. 22, 2016

(87) PCT Pub. No.: WO2015/011012
PCT Pub. Date: Jan. 29, 2015

(65) Prior Publication Data

US 2016/0160473 A1 Jun. 9, 2016

(30) Foreign Application Priority Data

Jul. 22, 2013 (EP) ..... 13382295

(51) Int. Cl.
*E02F 9/28* (2006.01)

(52) U.S. Cl.
CPC ..... *E02F 9/2825* (2013.01); *E02F 9/2858* (2013.01)

(58) Field of Classification Search
CPC ..... E02F 9/2883; E02F 9/2825; E02F 9/2841; E02F 9/2858; E02F 9/2808; E02F 9/2833;
(Continued)

(56) References Cited

U.S. PATENT DOCUMENTS 2,752,702 A 7/1956 Nelson
5,966,849 A * 10/1999 Moehnke ..... E02F 3/58 172/719

(Continued)

FOREIGN PATENT DOCUMENTS

EP 1710358 A1 10/2006
WO 98/05827 A1 2/1998

*Primary Examiner* — Robert Pezzuto
(74) *Attorney, Agent, or Firm* — Porzio Bromberg & Newman P.C.

(57) ABSTRACT

A wear assembly of an earth-moving machine's bucket comprises a male part and a female part both of which comprises a nose (male part) or cavity (female part) with an upper contact surface and a lower contact surface. The upper contact surface comprises an upper front contact portion that extends backward from the tip of the nose or the bottom of the cavity and the lower contact surface comprises a lower front contact portion that extends likewise, one of the upper and lower front contact portions being concave and the other being convex. Analogously, the upper contact surface comprises an upper back contact portion that extends forward from the base of the nose or the mouth of the cavity, and the lower contact surface comprises a lower back contact portion that extends likewise, one of the upper and lower back contact portions being concave and the other being convex.

26 Claims, 5 Drawing Sheets

(58) Field of Classification Search
CPC ..... E02F 9/2866; Y10T 403/4966; Y10T 403/7098
USPC ..... 172/701.1–701.3, 713, 719; 37/446, 37/452–460
See application file for complete search history.

(56) References Cited

U.S. PATENT DOCUMENTS

| | | | | |
|---|---|---|---|---|
| 5,987,787 | A * | 11/1999 | Mack ..... | E02F 9/2825 172/713 |
| 6,745,503 | B1 * | 6/2004 | Pallas Moreno ..... | E02F 9/2825 37/452 |
| 8,024,874 | B2 * | 9/2011 | McClanahan ..... | E02F 9/2883 37/446 |
| 2007/0044349 | A1 | 3/2007 | McClanahan et al. | |
| 2007/0227051 | A1 | 10/2007 | Carpenter et al. | |

* cited by examiner

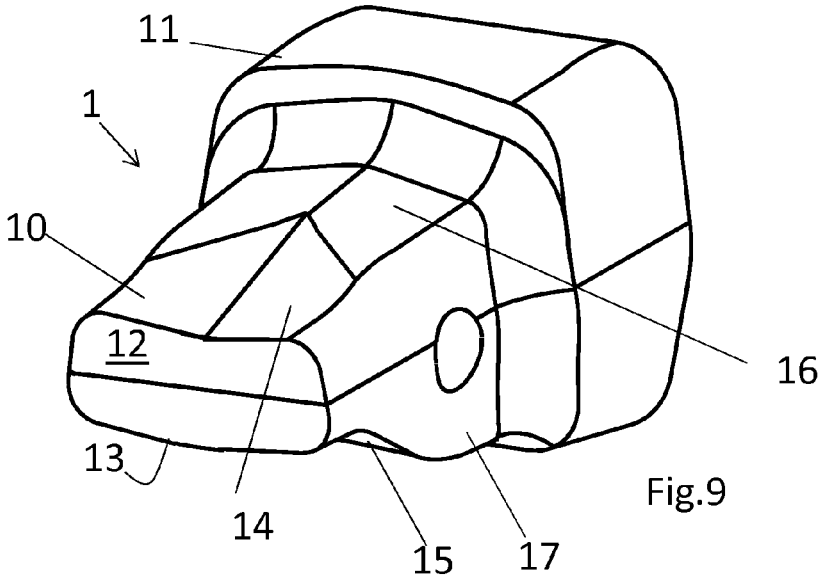
Fig.9
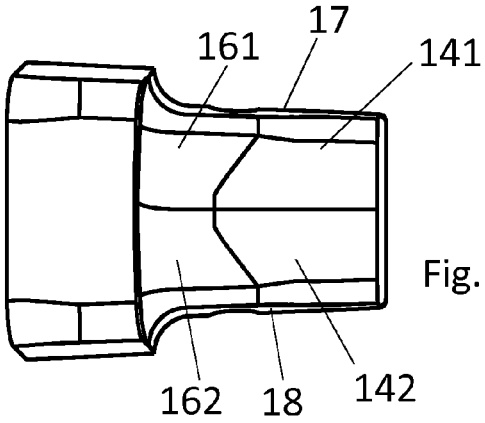
Fig. 10
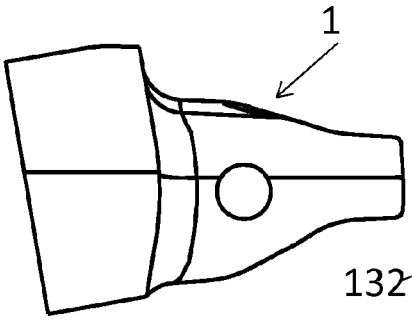
Fig. 11
Fig. 12
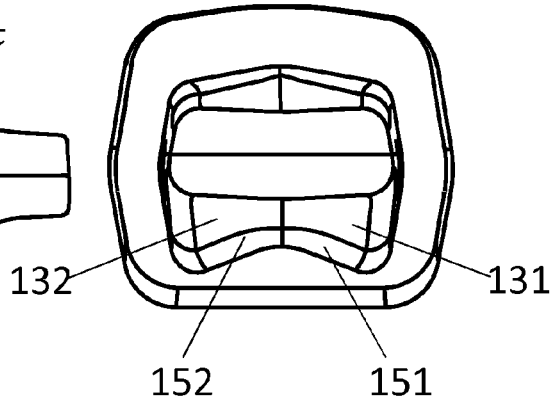

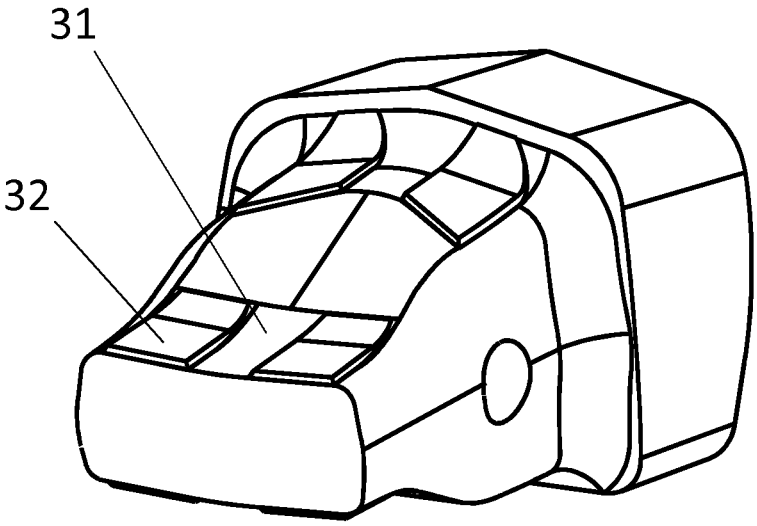
Fig. 13
Fig. 14
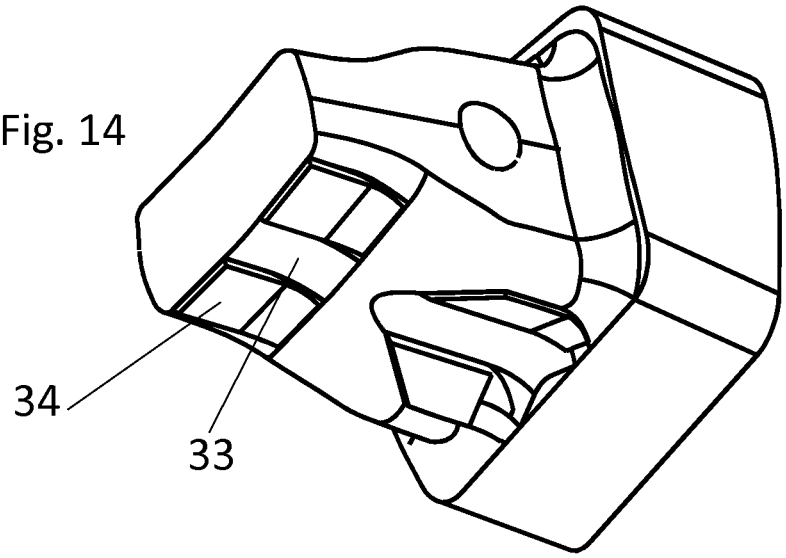

MALE AND FEMALE PARTS FOR A WEAR ASSEMBLY OF AN EARTH-MOVING MACHINE'S BUCKET

The present invention is related to a female part for a wear assembly of an earth-moving machine's bucket, said bucket and said female part having a length, a width and a height, identified with the orthogonal directions X, Y and Z, respectively, said female part comprising a cavity provided with an upper contact surface and a lower contact surface.

The invention is also related to a male part for such a wear assembly, said male part comprising a nose provided with an upper contact surface and a lower contact surface.

The invention is further related to a wear assembly comprising such a male and female parts.

BACKGROUND ART

The machines for tearing and moving materials such as earth and rocks, including excavators, loaders and the like, are usually provided with one or more shovels or buckets attached to a mechanical arm. The bucket is provided with a blade or bevelled lip on a front edge thereof intended to engage and penetrate the mass of earth and rocks. To prevent an excessive wear of the lip and to help penetrate the earth, it is common to assemble wear elements associated to the lip and projecting from the front thereof. Such a wear assembly comprises teeth or point members to tear the material up, and tooth-holders or adapters, attached to the lip or the bucket, that join the teeth to the lip.

Said wear elements cannot avoid being also subjected to wear and to large stresses that can deteriorate them, specially the teeth, so that they must be frequently replaced. Also, depending on the work the machine is intended for, it may be desirable to change the type or the shape of the teeth to improve their qualities.

Besides, the type of work in the earthmoving field may vary from light construction to normal construction, heavy construction and mining, and a specific work usually determines the size of the machine and the type of wear assembly, because the mechanical requirements are different.

For example, in construction works the machines are smaller than in mining works and the loads and stresses are bigger in mining works than in public works. With light loads, a two-part wear assembly is mostly used, namely, an adapter attached to the lip, e.g. welded (though another attachment is of course not ruled out), and a tooth coupled to said adapter. Usually, the adapter is configured as a male part and the tooth is configured as a female part, but in some cases the opposite is true and the assembly is then called "inverse system".

In mining works, where the loads to resist are bigger, it is common to use three-part wear assemblies comprising a point member (tooth), an intermediate member and a cast or weld-on member (adapter). Said three-part assemblies are used when the weight of the assembly is very high, so that increasing the number of elements facilitates their handling. A three-part wear assembly is also useful because the ratio of usable wear material is increased. Usually, the intermediate member is provided with a male part at its front region and a female part at its back region, the point member is configured as a female part and the adapter is configured as a male part. But other dispositions are possible, for examples in inverse systems.

The coupling between the different parts is maintained by means of a retaining element, usually a pin, which can be vertical or lateral.

The service life of the coupling is limited due to:

plastic deformation of the material due to the reactions for counteracting the exerted forces;

fatigue: it is calculated that a tooth with a normal duration performs more than 50,000 work cycles; as a result, the coupling must be designed to prevent the defects occurring because of fatigue phenomena, such as cracks or other defects;

wear, it being necessary to distinguish two types of wear:

1. Outer wear of the parts due to the flow of the material.
2. Inner wear due to the fine materials that are introduced between the two elements (tooth-tooth bar), whereby an abrasive effect is produced with the movements between the two elements which gradually wears them out.

The fitting or attachment of the wear assembly is formed by the contact surfaces of the male and female parts, where the loads are transmitted from the point of the wear element to the lip of the bucket through the adapter element.

When the machine is working, the point of the tooth engages the terrain in different directions, which causes stresses on the tooth that are transferred from the point thereof to the contact surfaces that contact the male part, i.e. they go from the point to the adapter (or to the intermediate element in case of a three-part assembly) and from the adapter to the bucket, so that the stresses are unloaded from the assembly and also from the pin.

In traditional wear assemblies, the housing or cavity in the female part and the complementary nose of the male part are wedge-shaped. Upon applying a force on the tooth, this shape generates reaction forces on the adapter that tend to separate these two elements, or even to break the tooth, and to stress the pin, which can lead to a very dangerous situation because a fallen-out pin can cause the tooth to fall out too, which can be very harmful because a tooth collected as earth can break any subsequent machinery (for example a crusher). Moreover, the loads are transmitted in all directions and tend to deteriorate the wear assembly, particularly the contact or bearing surfaces between the wear assembly elements, and also the pin.

The document WO2007/097984 discloses a wear assembly for securing a wear member to excavating equipment that includes a base having a nose and a wear member having a socket. The nose and socket are each provided with one or more complementary stabilizing surfaces in central portions thereof. But it is found that said surfaces are not bearing enough to stabilize the wear assembly when large loads act in different directions at the same time.

SUMMARY

The present disclosure aims to reduce or redirect the stresses to alleviate the wear assembly.

In the following, "forward" denotes the longitudinal sense toward the point of the tooth and "backward" denote the opposite sense.

According to a first aspect, a female part for a wear assembly of an earth-moving machine's bucket, said bucket and said female part having a length, a width and a height, identified with the orthogonal directions X, Y and Z, respectively, comprises a cavity provided with an upper contact surface and a lower contact surface, said upper contact surface comprising an upper front contact portion that extends backward from the bottom of the cavity and said lower contact surface comprising a lower front contact portion that extends backward from the bottom of the cavity, one of said upper and lower front contact portions being concave and the other being convex. For example, both the upper and lower front contact portions of the cavity may present a V shape (in which case the upper front contact portion would be convex and the lower front contact portion would be concave) or a Λ shape (in which case the upper front contact portion would be concave and the lower front contact portion would be convex). Both the upper front contact portion and the lower front contact portion are symmetrical with respect to the central XZ plane, which is the XZ plane passing through the centre of the cavity's mouth.

In some embodiments, both the upper front contact portion and the lower front contact portion may comprise a right front face and a left front face and said faces may be substantially flat. The right front faces may lie to one side of the central XZ plane and the left front faces may lie to the other side thereof, and they may be symmetrical with respect to said central XZ plane.

In some embodiments, the upper front contact portion may be parallel to the lower front contact portion on any cross-section parallel to the YZ plane; they may even be substantially parallel considering the entire contact portions or they may instead taper, for example toward the bottom of the cavity. In other embodiments, the upper and lower front contact portions may not be parallel at all.

Referring now to the back contact portions of the cavity, the upper contact surface comprises an upper back contact portion that extends forward from the mouth of the cavity and the lower contact surface comprises a lower back contact portion that extends forward from the mouth of the cavity, one of said upper and lower back contact portions being concave and the other being convex. The considerations previously made with respect to the front contact portions apply likewise to the back contact portions.

In some embodiments, the cavity taper toward its bottom in an intermediate portion between the upper front contact portion and the upper back contact portion and between the lower front contact portion and the lower back contact portion.

In some embodiments, the upper back contact portion may be concave and the upper front contact portion may be convex (in which case the lower back contact portion would be convex and the lower front contact portion would be concave), or vice versa. That is, a V shape at the front contact portions may turn to a Λ shape at the back contact portions, or vice versa.

In some embodiments, the cavity may be provided with two concave (as seen from the cavity) side surfaces that are symmetrical with respect to the central XZ plane. In some embodiments, each of said side surfaces may comprise an upper side face and a lower side face that are flat; said faces are inclined with respect to the XY plane (to provide the concavity) and, in some cases, may be symmetrical with respect to a particular XY plane.

According to a second aspect, a male part for such a wear assembly comprises a nose provided with an upper contact surface and a lower contact surface, said upper contact surface comprising an upper front contact portion that extends backward from the tip of the nose and said lower contact surface comprising a lower front contact portion that extends backward from the tip of the nose, one of said upper and lower front contact portions being concave and the other being convex. For example, both the upper and lower front contact portions of the nose may present a V shape (in which case the upper front contact portion would be concave and the lower front contact portion would be convex) or a Λ shape (in which case the upper front contact portion would be convex and the lower front contact portion would be concave).

As can be seen, the male part is defined in a manner analogous to the female part substituting convex for concave (and vice versa), nose for cavity and nose's tip for cavity's bottom. The considerations previously made with respect to the female part apply likewise to the male part (further substituting nose's base for cavity's mouth).

In a manner analogous to that of the female part, the nose of the male part may taper toward its front end in an intermediate portion between the upper front contact portion and the upper back contact portion and between the lower front contact portion and the lower back contact portion.

In a manner analogous to that of the female part, the nose of the male part may be provided with two convex side surfaces that are symmetrical with respect to the central XZ plane. Said convex side surfaces, when interacting with the corresponding concave side surfaces of the female part, contribute to counteract the side forces and thus help to stabilize the fitting between the male and female parts.

The wear assembly may comprise a wear element that is such a female part and such a male part, so that the nose of the male part is fitted in the cavity of the female part, defining a fitting with a longitudinal axis, and wherein the upper contact surface of the female part is complementary of the upper contact surface of the male part and the lower contact surface of the female part is complementary of the lower contact surface of the male part. As mentioned, the loads acting on the point may have different directions and intensity and hence can generate reactions on the bearing surfaces that tend to rotate the tooth and extract it from the adapter but, thanks to the V or Λ shape of the front and back contact portions of both the male and female part, these reactions are compensated as the V and Λ shapes tend to tight the female part on the male part because their fitting distributes the reactions generated during the operation or use of the wear assembly, so that the retention of the female part on the male part is favoured and the stresses to which the fitting system and the retaining system, and specifically the pin thereof, is subjected are reduced.

This is achieved because the different parts have a fitting area provided with contact surfaces (o bearing areas) that are complementary to one another in a particular way (based on the V or Λ shape), so as to achieve a complete stabilization of the male and female parts when the wear assembly is subjected to working stresses. The object of this stabilization is to prevent, or at least to hinder, the wear element from coming off to the front by naturally tightening it to the adapter, and to reduce the stresses to which the wear element, the adapter and the pin are subjected, whereby the useful life of the elements of the wear assembly is extended.

Specifically, the coupling between the male part and the female part and the contact between their bearing (i.e., contact) surfaces allows generating reaction forces on said contact surfaces as a response to the forces exerted at the point, said reaction forces tending to tight the male part in the female part, thus reducing the stresses of the wear assembly and extending its service life. The wear assembly has also a good access to the parts to let the contact surfaces, which may preferably be relatively high surfaces, be repaired.

The upper and lower contact portions of the male and female parts are contact areas between the male part and the female part. In general, it has to be understood that a contact surface of a male/female part is a surface that has been designed to be in contact with a corresponding contact surface of the respective female/male part. So, also if a male or female part is considered as an isolated part, their contact surfaces are clearly defined.

In some embodiments, either the male or the female part (depending on which is the wear element) may comprise a lower outer longitudinal recess, which may preferably extend from the front to the back of the wear element, e.g., the recess may cover the full, or almost the full (more than three quarters, say), length of the wear element. Said recess may be substantially parallel to at least a portion of the lower contact surface of the cavity, for example to one lower back contact portion; in other words, the recess may be parallel to the lower contact areas of the wear element with the other element (to be coupled to the former), thus creating a uniform thickness thereat. Said recess reduces the section of the wear elements to improve penetration, which also collaborates to reduce the stress. It is important to facilitate the penetration of the tooth into the ground because, as the tooth wears its section out at the point, there is more resistance to penetration and the effort required from the machine is raised, whereby the fuel consumption and the production cost are increased. The lower recess can strike a balance between a continuing good penetration and a good-resistant section.

In some embodiments, the centre of mass of the wear element is below the longitudinal axis of said fitting (central X direction), i.e., there is more material at the lower wear region. This is advantageous because the wear element becomes precisely more worn out at said region.

In three-part assemblies there are two wear assemblies, the first one between the point and the intermediate member and the second one between the intermediate member and the adapter. In some embodiments said first and second wear assemblies may be equal, but in other embodiments they may be different. For instance, the V or Λ arrangement may be different or opposite from the first wear assembly to the second one.

As it has already been mentioned, the male parts suffer plastic deformation or inner wear that could spoil its contact areas (symmetrical surfaces). When using three-part wear assemblies, it is usual to repair the contact areas to extend their live. It is thus advantageous for the contact areas to be big, flat and accessible to facilitate the rebuilt of the nose of the male part.

BRIEF DESCRIPTION OF THE DRAWINGS

Some particular embodiments of the present invention will be described in the following, only by way of non-limiting example, with reference to the appended drawings, in which:

FIG. 9 is a perspective view of a male part;

FIG. 10 is a top view of the male part of FIG. 9;

FIG. 11 is a side view of the male part of FIG. 9;

FIG. 12 is a front view of the male part of FIG. 9;

FIG. 13 is a perspective view of another embodiment of a male part; and

FIG. 14 is a bottom perspective view of the male part of FIG. 13.

DESCRIPTION OF PARTICULAR EMBODIMENTS

Some embodiments are described below with reference to the aforementioned figures for the purpose of a better understanding of the wear assembly.

Figure 1:
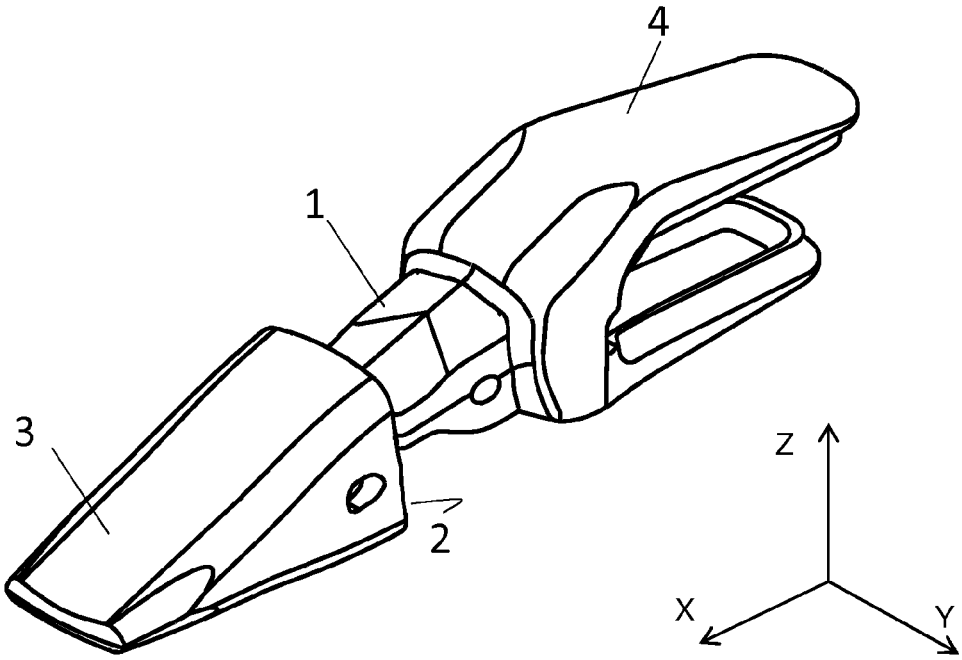
FIG. 1 is a perspective view of a two-part wear assembly.
Figure 2:
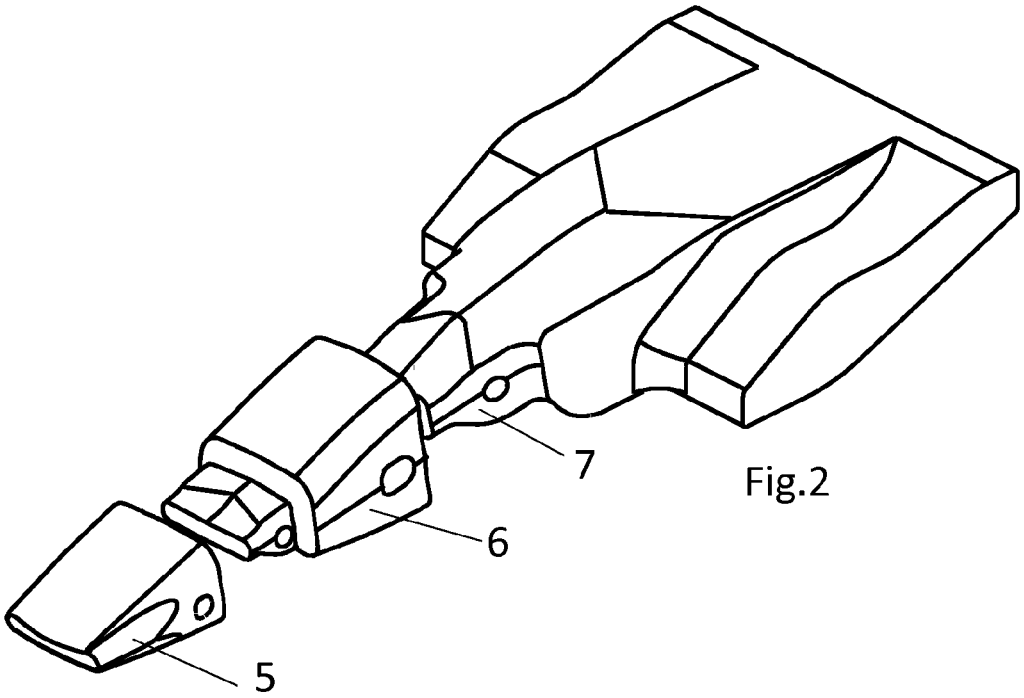
FIG. 2 is a perspective view of a three-part wear assembly.

The elements or parts that are comprised in the wear assembly for a bucket may be different depending on the intended use. FIG. 1 shows a two-part wear assembly provided with a male part 1 and a female part 2; in this case, the female part is a tooth 3 and the male part is an adapter 4. FIG. 2 shows a three-part wear assembly provided with a point 5, an intermediate element 6 and a weld-on (or cast or otherwise attached) nose 7. FIG. 1 also shows three orthogonal axes X, Y, Z; X is the longitudinal axis, Y is the horizontal axis and Z is the vertical axis (said axes can also be viewed with reference to the bucket: X, Y and Z extend in the direction of the length, width and height, respectively, of the bucket).

A female part as an intermediate element in a three-part assembly is shown with more detail in FIGS. 3-8. Said female part 2 comprises a cavity 20 which extends from an aperture 21 (mouth of the cavity) to a front inner surface 22 (bottom of the cavity), an upper front contact portion 24, a lower front contact portion 23, an upper back contact portion 26 and a lower back contact portion 25. Neither the front nor the back contact portions are symmetrical with respect to any plane parallel to the XY plane (a "horizontal" plane), but they are symmetrical with respect to the central XZ plane (the vertical longitudinal plane).

Each of said four contact portions, 23, 24, 25 and 26, comprises a pair of surfaces inclined with respect to the XZ plane, which means that they are not parallel to the Y axis; as hinted, said inclined surfaces are symmetrical with respect to the XZ plane. The inclination may be downwards or upwards, i.e., the contact areas formed by said portions may be convex or concave, or, in other words, said contact areas may present a V shape or a Λ shape.

Figure 3:
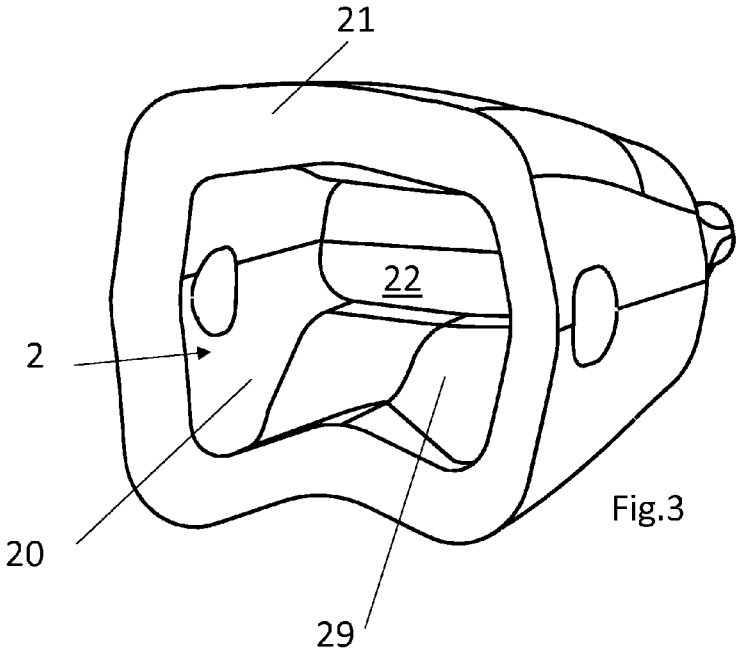
FIG. 3 is a rear perspective view of a female part.
Figure 6:
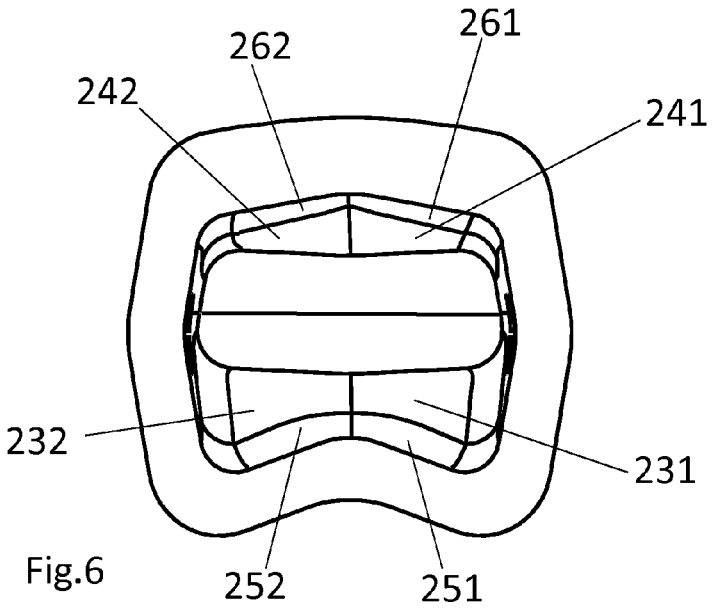
FIG. 6 is like FIG. 5 but enlarged.
Figure 7:
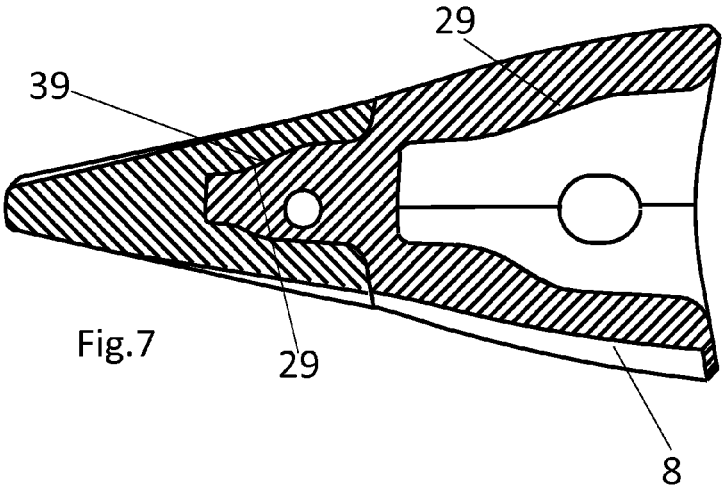
FIG. 7 is a longitudinal cross-section of the female part of FIG. 3 fitted to a tip element.
Figure 8:
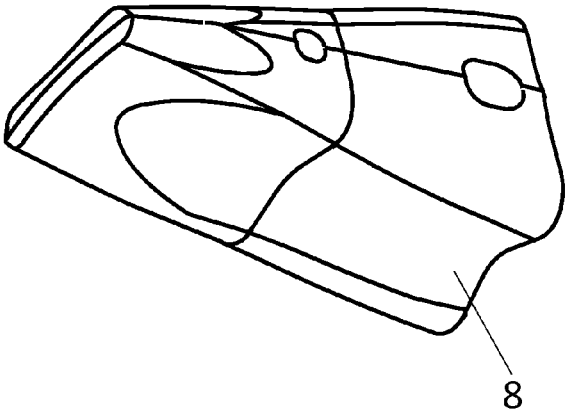
FIG. 8 is a bottom perspective view of the female part of FIG. 3.

As can be seen in FIGS. 3 and 7, between the upper front contact portion 24 and the upper back contact portion 26, and between the lower front contact portion and the lower back contact portion 25, there is an intermediate portion 29 in which the cavity of the female part 2 taper toward its bottom As can be seen in FIG. 6, the lower front contact portion 23 is provided with a right lower front surface 231 and a left lower front surface 232 which are symmetrical with respect to the XZ plane; the upper front contact portion 24 is provided with a right upper front surface 241 and a left upper front surface 242 which are symmetrical with respect to the XZ plane; the lower back contact portion 25 is provided with a right lower back surface 251 and a left lower back surface 252 which are symmetrical with respect to the XZ plane; and the upper back contact portion 26 is provided with a right upper back surface 261 and a left upper back surface 262 which are symmetrical with respect to the XZ plane.

In the figures, the shape of the front contact surfaces 23 and 24 and the back contact surfaces 25 and 26 are inverted, that is, the front contact surfaces present a V shape and the back contact surfaces present a Λ shape, and there is a flat transition surface therebetween, but other embodiments are possible (e.g., the front and back shapes may be more or less the same).

Figure 5:
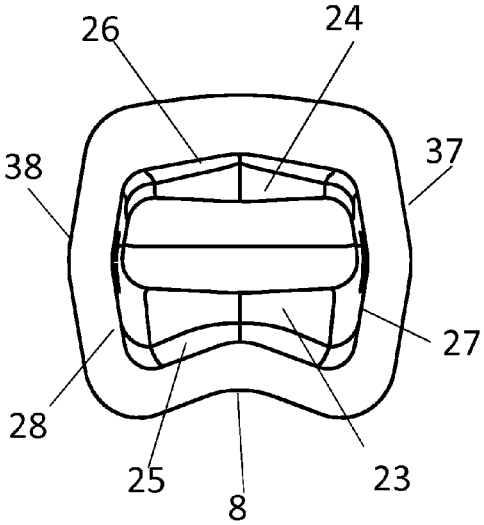
FIG. 5 is a rear view of the female part of FIG. 3.

As can be seen in FIG. 5, the female part comprises two side outer surfaces 37 and 38 which are inclined and symmetrical with respect to both the XZ plane and the XY plane. Said side surfaces are convex, which improves penetration at the point region because the cross-section of the wear element thereat is reduced by having done away with the corners.

The cavity also comprises two side inner concave surfaces 27 and 28 that are inclined and symmetrical with respect to both the XZ plane and the XY plane.

A male part as an intermediate element in a three-part assembly is shown with more detail in FIGS. 9-12. Said male part 1 comprises a nose or projection 10 which extends from a shoulder 11 to a front outer surface 12, an upper front contact portion 14, a lower front contact portion 13, an upper back contact portion 16 and a lower back contact portion 15. The front contact portions 13 and 14 are almost parallel to each other, in the sense that, when intersected by a plane parallel to the YZ plane (a transversal plane), the upper and lower intersecting curves are parallel; they may also be parallel in the direction X, in which case they are substantially parallel. Analogously, the back contact portions 15 and 16 are almost parallel to each other, in the sense that, when intersected by a plane parallel to the YZ plane, the upper and lower intersecting curves are parallel; they may also be parallel in the direction X, in which case they are substantially parallel. Neither the front nor the back portions are symmetrical with respect to any plane parallel to the XY plane (a "horizontal" plane), but they are symmetrical with respect to the central XZ plane (the longitudinal plane).

Each of said four portions, 13, 14, 15 and 16, comprises a pair of surfaces inclined with respect to the XZ plane, which means that they are not parallel to the Y axis; as hinted, said inclined surfaces are symmetrical with respect to the XZ plane. The inclination may be downwards or upwards, i.e., the contact areas formed by said portions may be concave or convex, or, in other words, said contact areas may present a V shape or a Λ shape.

Figure 4:
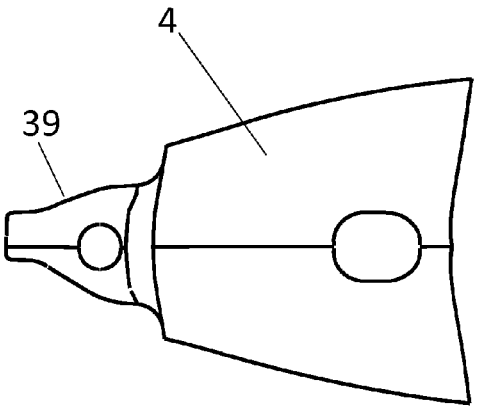
FIG. 4 is a side view of the female part of FIG. 3.

As can be seen in FIGS. 4 and 7, between the upper front contact portion 14 and the upper back contact portion 16, and between the lower front contact portion 13 and the lower back contact portion 15, there is an intermediate portion 39 in which the nose of the male part 1 taper toward its front end.

The lower front contact portion 13 is provided with a right lower front surface 131 and a left lower front surface 132 which are symmetrical with respect to the XZ plane ("right" and "left" are defined looking to the tip to keep a numbering analogous to that of the female part for corresponding elements); the upper front contact portion 14 is provided with a right upper front surface 141 and a left upper front surface 142 which are symmetrical with respect to the XZ plane; the lower back contact portion 15 is provided with a right lower back surface 151 and a left lower back surface 152 which are symmetrical with respect to the XZ plane; and the upper back contact portion 16 is provided with a right upper back surface 161 and a left upper back surface 162 which are symmetrical with respect to the XZ plane.

In the figures, the shape of the front contact surfaces 13 and 14 and the back contact surfaces 15 and 16 are inverted, that is, the front surfaces present a V shape and the back surfaces present a Λ shape, and there is a flat transition surface therebetween that is easily accessible to facilitate repairs on the male part surfaces (the relatively big size of the flat contact surfaces facilitates repairs on the nose too). But, just the same, both the front and back shapes may be concave or convex.

The nose also comprises two side surfaces 17 and 18 which are inclined and symmetrical with respect to both the XZ plane and the XY plane. Said side surfaces are convex and fit the corresponding side concave surfaces 27 and 28 of the female's part cavity.

The front and back contact surfaces may be curved, e.g. a sector of a sphere centred on the Z axis (and it may be analogous for the female part's surfaces). In this case, the behaviour of the wear assembly is similar to the previous case.

In another embodiment (FIGS. 13 and 14), the front and back contact surfaces are flat but they are separated by stretch 31 or 33 that is horizontal and parallel to the X axis. In this embodiment, the symmetrical surfaces of the male part can protrude, creating a series of steps 32 or 34 on the nose that serve as a visual indicator of deformation and wear.

In the above embodiments, the three-part wear assembly has the same coupling between the point 5 and the intermediate element 6 than between the latter and the nose 7, but these two couplings might also be different. For example, the V and Λ arrangement can be inverted from one coupling to the other, or the surfaces' inclinations could be different.

Last but not least, the point 5 and the intermediate element 6 of the wear assembly are provided with a lower external recess 8 (FIGS. 5 to 8) that is substantially parallel to the lower back and front contact surfaces, 23 and 25, of the female part 2 to improve the section for penetration.

Although only particular embodiments of the invention have been shown and described in the present specification, the skilled man will be able to introduce modifications and substitute any technical features thereof with others that are technically equivalent, depending on the particular requirements of each case, without departing from the scope of protection defined by the appended claims.

The invention claimed is:

1. A female part for a wear assembly of an earth-moving machine's bucket, said bucket and said female part having a length, a width and a height, identified with the orthogonal directions X, Y and Z, respectively, the female part comprising a cavity provided with an upper contact surface and a lower contact surface, wherein said upper contact surface comprises an upper front contact portion that extends backward from the bottom of the cavity and said lower contact surface comprises a lower front contact portion that extends backward from the bottom of the cavity, one of said upper and lower front contact portions being concave and the other being convex, wherein both the upper front contact portion and the lower front contact portion are symmetrical with respect to a central XZ plane, wherein the upper contact surface comprises an upper back contact portion that extends forward from a mouth of the cavity and the lower contact surface comprises a lower back contact portion that extends forward from the mouth of the cavity, one of said upper and lower back contact portions being concave and the other being convex, wherein the upper back contact portion is concave and the upper front contact portion is convex, or vice versa, and wherein the upper back contact portion is parallel to the lower back contact portion on any cross-section parallel to the YZ plane.

2. The female part according to claim 1, wherein both the upper front contact portion and the lower front contact portion comprise a right front face and a left front face that are substantially flat.

3. The female part according to claim 1, wherein said cavity tapers toward its bottom in an intermediate portion between said upper front contact portion and said upper back contact portion and between said lower front contact portion and said lower back contact portion.

4. The female part according to claim 1, wherein both the upper back contact portion and the lower back contact portion are symmetrical with respect to the central XZ plane.

5. The female part according to claim 1, wherein both the upper back contact portion and the lower back contact portion comprise a right back face and a left back face that are substantially flat.

6. The female part according to claim 1, wherein the cavity is provided with two side concave surfaces that are symmetrical with respect to the central XZ plane, each of said side surfaces comprising an upper side face and a lower side face that are flat.

7. The female part according to claim 1, comprising a lower outer longitudinal recess.

8. The female part according to claim 7, wherein said recess is substantially parallel to at least a portion of the lower contact surface of the cavity.

9. The female part according to claim 1, wherein the upper front contact portion is parallel to the lower front contact portion on any cross-section parallel to the YZ plane.

10. The female part according to claim 1, wherein the upper front contact portion is parallel to the lower front contact portion considering entire portions.

11. The female part according to claim 1, wherein the upper back contact portion is parallel to the lower back contact portion considering entire portions.

12. The female part according to claim 1, wherein said upper front contact portion and said lower front contact portion comprise each a pair of surfaces inclined with respect to the XZ plane.

13. The female part according to claim 1, wherein said upper back contact portion and said lower back contact portion comprise each a pair of surfaces inclined with respect to the XZ plane.

14. A male part for a wear assembly of an earth-moving machine's bucket, said bucket and said male part having a length, a width and a height, identified with the orthogonal directions X, Y and Z, respectively, the male part comprising a nose provided with an upper contact surface and a lower contact surface, wherein said upper contact surface comprises an upper front contact portion that extends backward from a tip of the nose and said lower contact surface comprises a lower front contact portion that extends backward from the tip of the nose, one of said upper and lower front contact portions being concave and the other being convex, wherein both the upper front contact portion and the lower front contact portion are symmetrical with respect to a central XZ plane, wherein the upper contact surface comprises an upper back contact portion that extends forward from a base of the nose and the lower contact surface comprises a lower back contact portion that extends forward from the base of the nose, one of said upper and lower back contact portions being concave and the other being convex, wherein the upper back contact portion is concave and the upper front contact portion is convex, or vice versa, and wherein the upper back contact portion is parallel to the lower back contact portion on any cross-section parallel to the YZ plane.

15. The male part according to claim 14, wherein both the upper front contact portion and the lower front contact portion comprise a right front face and a left front face that are substantially flat.

16. The male part according to claim 14, wherein said nose tapers toward its front end in an intermediate portion between said upper front contact portion and said upper back contact portion and between said lower front contact portion and said lower back contact portion.

17. The male part according to claim 14, wherein both the upper back contact portion and the lower back contact portion are symmetrical with respect to the central XZ plane.

18. The male part according to claim 14, wherein both the upper back contact portion and the lower back contact portion comprise a right back face and a left back face that are substantially flat.

19. The male part according to claim 14, wherein the nose is provided with two side convex surfaces that are symmetrical with respect to the central XZ plane, each of said side surfaces comprising an upper side face and a lower side face that are flat.

20. The male part according to claim 14, wherein the upper front contact portion is parallel to the lower front contact portion on any cross-section parallel to the YZ plane.

21. The male part according to claim 14, wherein the upper front contact portion is parallel to the lower front contact portion considering entire portions.

22. The male part according to claim 14, wherein the upper back contact portion is parallel to the lower back contact portion considering entire portions.

23. The male part according to claim 14, wherein said upper front contact portion and said lower front contact portion comprise each a pair of surfaces inclined with respect to the XZ plane.

24. The male part according to claim 14, wherein said upper back contact portion and said lower back contact portion comprise each a pair of surfaces inclined with respect to the XZ plane.

25. A wear assembly comprising a wear element that is a female part, said female part having a length, a width and a height, identified with the orthogonal directions X, Y and Z, respectively, the female part comprising a cavity provided with an upper contact surface and a lower contact surface, wherein said upper contact surface comprises an upper front contact portion that extends backward from the bottom of the cavity and said lower contact surface comprises a lower front contact portion that extends backward from the bottom of the cavity, one of said upper and lower front contact portions being concave and the other being convex, wherein both the upper front contact portion and the lower front contact portion are symmetrical with respect to a central XZ plane, wherein the upper contact surface comprises an upper back contact portion that extends forward from a mouth of the cavity and the lower contact surface comprises a lower back contact portion that extends forward from the mouth of the cavity, one of said upper and lower back contact portions being concave and the other being convex, wherein the upper back contact portion is concave and the upper front contact portion is convex, or vice versa, and wherein the upper back contact portion is parallel to the lower back contact portion on any cross-section parallel to the YZ plane, and a male part, said male part having a length, a width and a height, identified with the orthogonal directions X, Y and Z, respectively, the male part comprising a nose provided with an upper contact surface and a lower contact surface, wherein said upper contact surface comprises an upper front contact portion that extends backward from a tip of the nose and said lower contact surface comprises a lower front contact portion that extends backward from the tip of the nose, one of said upper and lower front contact portions being concave and the other being convex, wherein both the upper front contact portion and the lower front contact portion are symmetrical with respect to the central XZ plane, wherein the upper contact surface comprises an upper back contact portion that extends forward from the base of the nose and the lower contact surface comprises a lower back contact portion that extends forward from the base of the nose, one of said upper and lower back contact portions being concave and the other being convex, wherein the upper back contact portion is concave and the upper front contact portion is convex, or vice versa, and wherein the upper back contact portion is parallel to the lower back contact portion on any cross-section parallel to the YZ plane, wherein the male part's nose is fitted in the female part's cavity, defining a fitting with a longitudinal axis, and wherein the upper contact surface of the female is complementary of the upper contact surface of the male part and the lower contact surface of the female part is complementary of the lower contact surface of the male part.

26. The wear assembly of claim 25, wherein the center of mass of the wear element is below the longitudinal axis of said fitting.

* * * * *